United States Patent [19]

Young et al.

[11] Patent Number: 4,714,184

[45] Date of Patent: Dec. 22, 1987

[54] CAMERA CARRIER

[75] Inventors: Leon Young, Pacific Palisades, Calif.; Edward J. Klassen, deceased, late of Pacific Palisades, Calif., by Amelia K. Klassen, legal representative

[73] Assignee: Fotima International Ltd., Los Angeles, Calif.

[21] Appl. No.: 25,356

[22] Filed: Mar. 13, 1987

[51] Int. Cl.[4] ..... A45F 5/00

[52] U.S. Cl. ..... 224/253; 224/908; 224/185; D16/47; 294/139; 352/243; 354/293

[58] Field of Search ..... 224/908, 163, 185, 252, 224/253, 254; 294/139; 354/293; 252/243; 242/107; D14/10; D16/10, 47

[56] References Cited

U.S. PATENT DOCUMENTS

| | | | |
|---|---|---|---|
| D. 236,916 | 9/1975 | Welfe | D16/10 |
| D. 240,094 | 6/1976 | Cortes | D3/106 |
| D. 267,050 | 11/1982 | Ostrom | D3/33 |
| D. 268,300 | 3/1983 | Richards | D2/400 |
| D. 271,822 | 12/1983 | Clancy | D3/33 |
| 744,933 | 11/1903 | Nicholson | 224/253 |
| 2,130,262 | 9/1938 | Burlin | 229/908 X |
| 2,638,041 | 5/1953 | Horydczak | 354/293 |
| 2,711,122 | 6/1955 | Klumpp | 224/185 |
| 3,209,968 | 10/1965 | Flanagan | 224/255 |
| 3,305,148 | 2/1967 | Zimmerman | 224/255 |
| 3,608,794 | 9/1971 | Mazure | 224/255 |
| 3,762,616 | 10/1973 | Brunstetter | 224/208 |
| 3,870,209 | 3/1975 | Mazur | 224/908 X |
| 3,879,209 | 3/1975 | Mazur | 224/908 X |
| 3,910,470 | 10/1975 | Swenson | 224/208 |
| 3,912,137 | 10/1975 | Tomatsuri | 224/908 X |
| 3,984,855 | 10/1976 | Baczynsky | 224/908 X |
| 4,120,434 | 10/1978 | Hewes | 224/249 |
| 4,328,917 | 5/1982 | Reeberg | 224/908 X |
| 4,402,472 | 9/1983 | Burtscher | 242/107 |
| 4,446,997 | 5/1984 | Himberg | 224/908 X |
| 4,558,999 | 4/1987 | Hilty | 224/917 X |

FOREIGN PATENT DOCUMENTS

| | | | |
|---|---|---|---|
| 2368916 | 6/1978 | France | 224/908 |

*Primary Examiner*—Henry J. Recla
*Assistant Examiner*—Ernest G. Cusick
*Attorney, Agent, or Firm*—Kelly, Bauersfeld & Lowry

[57] ABSTRACT

An improved camera carrier is provided for convenient and secure belt-mounted carrying of a camera. The camera carrier includes a belt-mounted frame having a support plate for receiving and supporting a carrier plate which is adapted in turn for attachment to a camera. A flexible tether line is connected between the carrier plate and a spring reel on the frame. The tether line accommodates camera movement between a stored position rested securely on the support plate for easy carrying and an operational position withdrawn from the support plate for normal photographic use.

16 Claims, 12 Drawing Figures

CAMERA CARRIER

BACKGROUND OF THE INVENTION

This invention relates generally to apparatus designed to facilitate carrying and use of cameras. More specifically, this invention relates to an improved and relatively simple belt-mounted camera carrier.

A wide variety of still photography and motion picture cameras are used in photographically recording a virtually infinite range of scenes and events. In this regard, cameras are frequently carried by individuals having the intent to photograph various scenes and events on a planned or spontaneous basis. For this purpose, in the prior art, a wide range of camera carrying equipment has been proposed to facilitate carrying of a camera preferably in a manner safeguarding the camera against undesired damage, loss and theft. Common camera carrying devices include, for example, elongated straps designed to permit suspension of the camera from a persons neck, shoulder, etc. Other types of popular camera carriers include camera bags which typically include elongated shoulder straps and the like for easy portability.

For some persons and/or for some types of camera equipment, however, shoulder straps and/or neck straps can be relatively uncomfortable for use in transporting a camera, for example, over an extended time period. With this in mind, a variety of alternative camera carrying devices have been proposed typically to include a bracket or holster device adapted for mounting onto the belt of a person carrying the camera. In such devices, the camera is normally removed entirely from the bracket or holster for use in taking pictures. Alternately, in some designs, the camera and bracket/-holster device are removed from the belt as a unit for picture taking purposes. See, for example, U.S. Pat. Nos. 3,910,470; 3,762,616; 2,209,968; 4,120,434 and D240,094. However, this relatively easy removal of the camera from the belt-mounted position undesirably subjects the camera to relatively easy loss or theft and further subjects the camera to potential damage in the event of accidental dropping.

There exists, therefore, a significant need for an improved camera carrier adapted for convenient belt-mounted carrying of a camera while protecting the camera against undesired loss or damage. The present invention fulfills these needs and provides other related advantages.

SUMMARY OF THE INVENTION

In accordance with the invention, a relatively compact and easy-to-use camera carrier is provided for supporting a camera in a secure and stable manner from the belt of a person carrying the camera. The camera carrier includes a flexible tether line secured to the camera at all times wherein this tether line can be extended and retracted as needed to permit normal camera use.

In the preferred form of the invention, the camera carrier comprises a lightweight frame adapted for secure mounting onto the belt of a person. In general terms, the belt-mounted frame includes a support plate having a size and shape for supporting an overlying carrier plate adapted for connection to a camera, for example, by fastener means or the like fastened into a conventional tripod mount on the camera. The flexible tether line is wound about a spring-loaded reel carried by the frame. A free end of the tether line is attached to the carrier plate, thereby maintaining a flexible connection between the carrier plate and the frame at all times.

The flexible tether line is normally urged by the spring-loaded reel toward a normal position wound about the reel in a substantially retracted or stored position. In this state, the camera and its carrier plate are rested upon the frame support plate for easy camera carrying. Guide means are cooperatively engaged between the carrier and support plates for retaining the carrier plate in a secure and stable manner without significant rocking or tipping. However, the camera can be used at any time by manually lifting the camera and attached carrier plate from the support plate for normal photographic use, with the tether line being thereupon extended or withdrawn from the spring reel as required. Accordingly, by virtue of the tether line, the camera cannot be separated completely from the belt-mounted frame, thereby guarding against undesired loss or dropping of the camera.

In accordance with further features of the invention, the carrier plate is adapted for secure mounting onto the camera, preferably by connection of a fastener through the carrier plate and into a threaded bore provided normally on the camera for tripod mounting purposes. The carrier plate mounting means is designed to accommodate secure carrier plate attachment to a range of different cameras having tripod-mount bores in one of a range of different positions.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
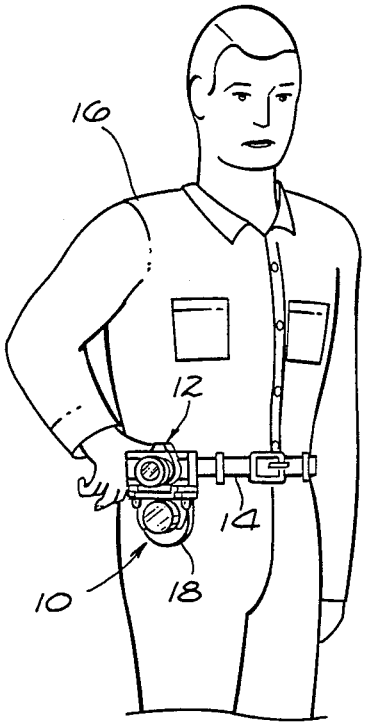
FIG. 1 is a perspective view illustrating a camera carrier embodying the novel features of the invention and shown supporting a camera in a stored position suspended from the belt of a person wearing the camera carrier.

As shown in the exemplary drawings, an improved camera carrier referred to generally by the reference numeral 10 is provided for convenient carrying of a camera 12 while permitting substantially immediate deployment of the camera for normal photographic use. The camera carrier 10 supports the camera 12 in a secure and stable manner from the belt of a person 16 carrying the camera, as viewed in FIG. 1. However, the camera can be withdrawn quickly and easily from the belt-mounted position for use in taking pictures, as viewed in FIG. 2.

Figure 2:
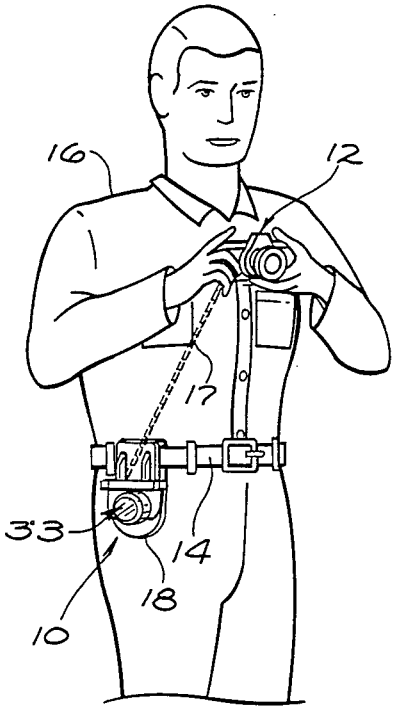
FIG. 2 is a perspective view similar to FIG. 1 but illustrating normal photographic use of the camera.

The improved camera carrier 10 of the present invention provides a flexible tether line 17 which remains connected between the camera 12 and the carrier 10 at all times. This tether line 17 is spring-loaded for normal retraction to a substantially concealed, out-of-the-way position when the camera 12 is supported at the person's belt 14 (FIG. 1). However, the tether line 17 extends with relatively minimal resistance when the camera 12 is accessed for normal operation in photography (FIG. 2). Accordingly, the camera 12 remains physically attached to the carrier 10 at all times, thereby preventing inadvertent dropping or theft of the camera. Moreover, the tether line 17 advantageously is provided with a maximum length to prevent the camera from striking the gound, if inadvertently dropped. As a result, the tether line 17 prevents camera loss and/or accidental damage while permitting substantially immediate camera access for photography purposes.

Figure 3:
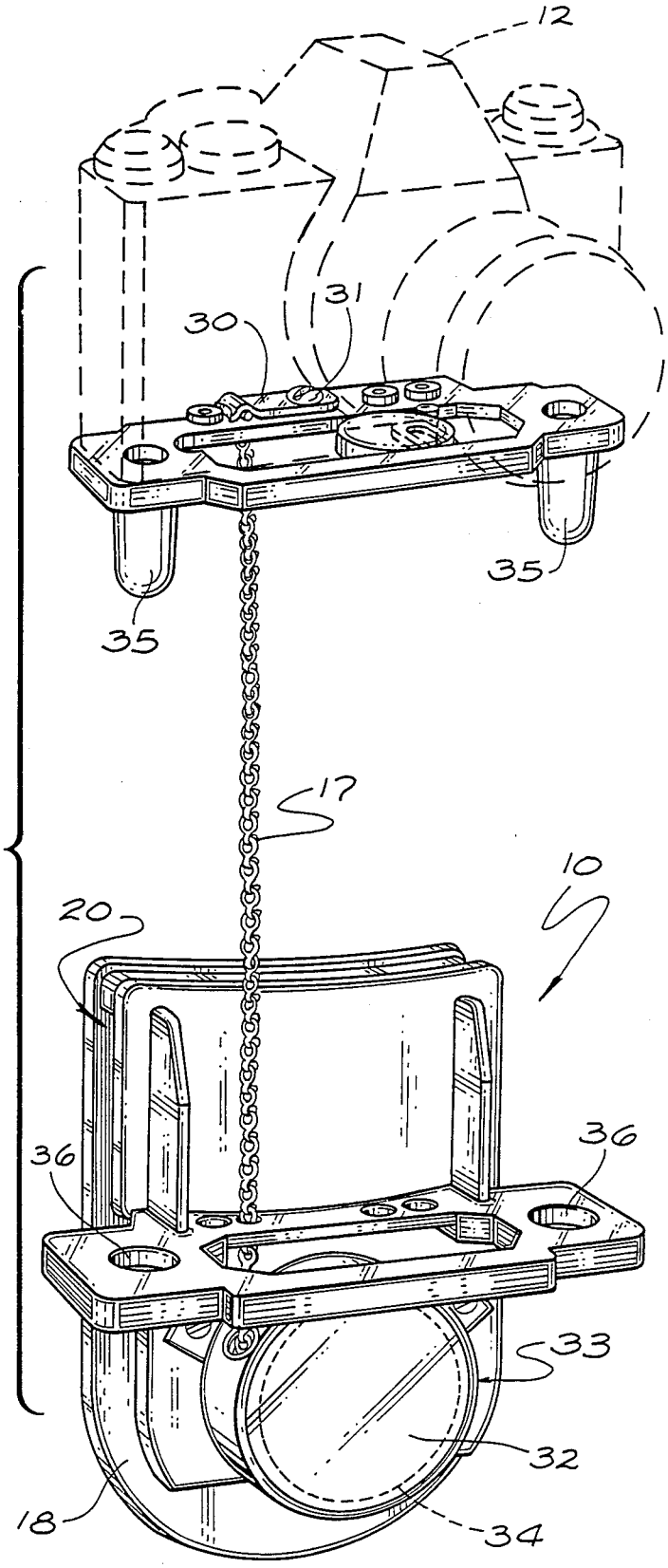
FIG. 3 is an enlarged exploded perspective view illustrating the camera carrier of FIGS. 1 and 2.
Figure 4:
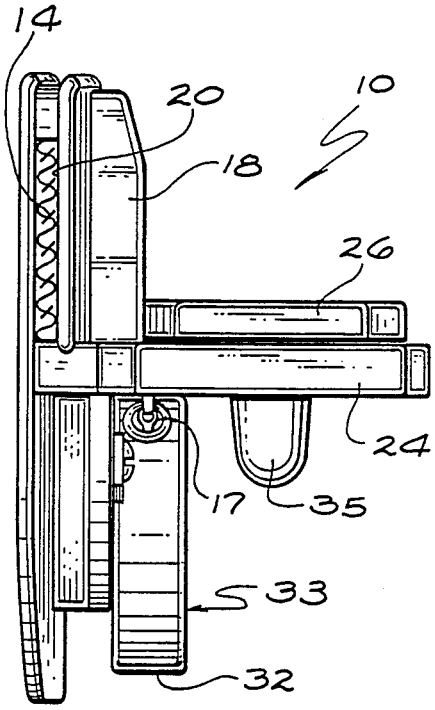
FIG. 4 is a side elevation view of the camera carrier.

As shown in more detail in FIGS. 3 and 4, the camera carrier 10 comprises a relatively compact frame 18 which may be formed from a lightweight molded plastic or the like. The frame 18 is shaped to include a laterally open slot 20 of appropriate size and shape for passage therethrough of the person's belt 14. Accordingly, the carrier frame 18 can be mounted quickly and easily onto the person's belt 14, followed by normal closure or buckling of the belt to prevent unauthorized removal from the person 16. Conveniently, for enhanced wearer comfort, the frame 18 includes an inboard face of an arcuately concave configuration roughly matching the curved contour of the person's body.

Figure 5:
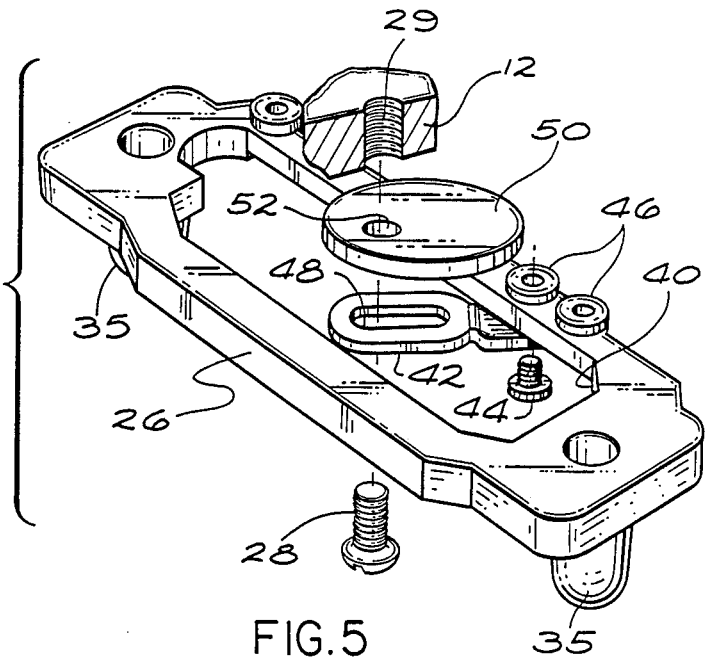
FIG. 5 is an exploded perspective view depicting construction of a carrier plate forming a portion of the invention.

The camera carrier frame 18 includes a generally horizontal support plate 24 which projects outwardly a short distance from the person's body. This support plate 24 has a size and shape for supporting a carrier plate 26, which may also be formed from a lightweight molded plastic or the like, and has an overall size and shape approximating the footprint of the camera 12 to be carried. In this regard, the camera 12 as shown in dotted lines in FIG. 3 comprises a 35 mm camera of a generally standard overall size and shape, although it will be understood that the invention can be adapted for use with other types of cameras. The carrier plate 26 is adapted for secure attachment to the underside of the camera 12 in any convenient manner, such as by use of a connector screw 28 fastened through the carrier plate 26 and into a threaded bore 29 in the camera body (FIG. 5).

The tether line 17 is shown in FIG. 3 in the form of a lightweight flexible chain having a free end secured to the carrier plate 26. Although a variety of different chain connection arrangements can be used, the illustrative drawings depict the chain free end locked beneath an anchor clip 30 which is fastened in turn to the carrier plate 26 by a screw 31 or the like. From this anchor clip 30, the flexible chain tether line 17 extends downwardly from the carrier plate and through a port in the support plate 24 before passing into the generally cylindrical case 32 of a spring-loaded reel assembly 33 mounted on the frame 18. The reel assembly 33 imparts a relatively small spring force urging the tether line 17 toward a normally concealed or retracted position 34 wound into the case 32, thereby urging the tether line 17 toward a minimum length position with the carrier plate 26 rested upon the support plate 24. In this position, guide means such as downwardly protruding guide posts 35 on the carrier plate are seated within aligned guide openings 36 in the support plate, wherein this guide means assists in retaining the carrier plate 26 and the camera 12 connected thereto in a secure and stable manner, substantially without rocking or tipping motion as the camera 12 is carried at the person's belt.

The camera 12 can be deployed quickly and easily for normal use by the person 16 by manually grasping the camera 12 and lifting it with the carrier plate 26 from the support plate 24. Such lifting action is accompanied by extension of the spring-loaded tether line 17, wherein this tether line has sufficient overall free length to permit maneuvering of the camera for normal view finding during photographic use. However, in the event the camera is inadvertently dropped from the support plate 24 or from the person's hands during attempted use, the length of the tether line 17 is chosen to prevent the camera 12 from striking the floor or ground when carried at the belt of a person of normal height. Upon completion of use, the camera 12 and the underlying carrier plate 26 can be returned quickly and easily to the stored position rested upon the support plate 24, with the tether line 17 rewinding into the reel assembly case 32.

In accordance with one aspect of the invention, the carrier plate 26 is adapted for connection relatively quickly and easily to a variety of different camera makes and models, wherein such cameras are provided with the threaded bore 29 on the underside of the camera body, for example, for optical attachment to a tripod structure (not shown). In this regard, many commercially available cameras particularly such as 35 mm cameras are known to provide the tripod-mount bore 29 in a range of different specific locations on the underside of the camera body. The carrier plate 26 of the camera carrier 10 is adapted for secure connection to the tripod-mount bore 29 in a manner accommodating a virtually infinite range of specific bore locations.

Figure 6:
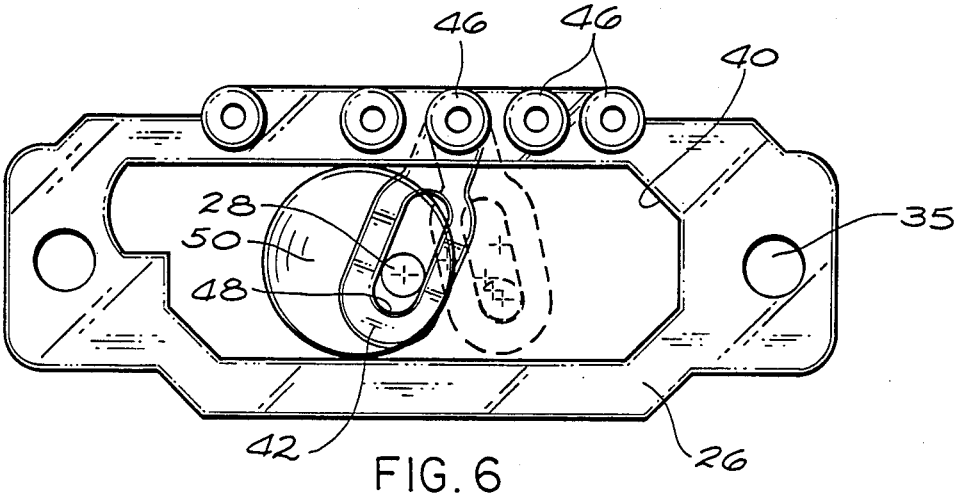
FIG. 6 is a top plan view of the carrier plate of FIG. 5.
Figure 7:
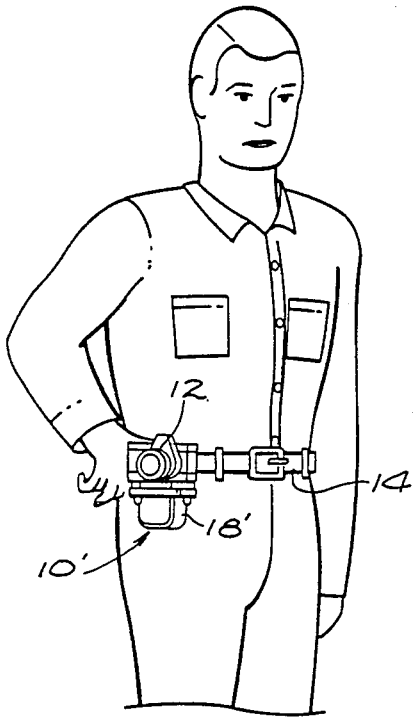
FIG. 7 is a perspective view similar to FIG. 1, but depicting an alternative preferred form of the invention.
Figure 8:
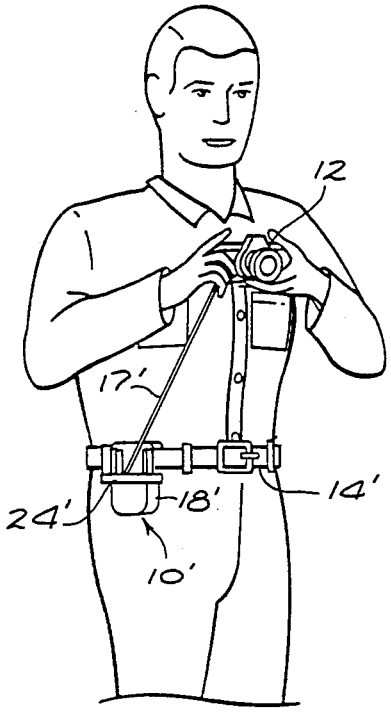
FIG. 8 is a perspective view similar to FIG. 2, but depicting the alternative preferred form shown in FIG. 7.

More specifically, with reference to FIGS. 5 and 6, the illustrative carrier plate 26 has a transversely elongated central passage 40 formed therein, wherein the boundaries of this passage 40 defined by a relatively complex polygonal configuration. The open area bounded by this central passage 40 is selected to circumscribe the anticipated possible locations of the threaded tripod-mount bore 29 formed in the camera body to be mounted on the carrier plate 26. The carrier plate 26 is securely fastened to the underside of the camera body by means of a connector link 42 fastened by an anchor screw 44 or the like which is passed upwardly through the connector link 42 and fastened into a selected one of several downwardly open bosses 46 on the carrier plate 26. The connector link 42 has an elongated slot 48 formed therein for upward passage of the connector screw 28. Importantly, the particular location and angular orientation of the connector link 42 relative to the carrier plate 26 are selected to align a portion of the link slot 48 beneath the tripod-mount bore 29 when the camera is rested upon the carrier plate 26 (FIG. 3). A spacer disk 50 is received into the connector plate passage 40 in overlying relation with the connector link 42 and includes an open port 52 formed therein. Conveniently, this spacer disk has a thickness at least slightly greater than the thickness of the carrier plate 26 and thus may be sandwiched tightly between the connector link 42 and the underside of the camera body when the connector screw 28 is fastened into the tripod-mount bore 29. Importantly, this combination of carrier plate components permits secure camera attachment into the tripod-mount bore of a camera, wherein the bore is located in virtually any position within the boundaries of the elongated plate passage 40.

An alternative preferred form of the invention is shown in FIGS. 7–12, wherein components corresponding with those shown and described in FIGS. 1–6 are referred to by corresponding primed reference numerals. In this alternative embodiment a modified camera carrier 10' includes a frame 18' with an appropriate slot 20' for secure attachment onto the belt 14 of a person carrying the camera. When the frame 18' is attached to the person's belt, the carrier 10' provides secure and stable support for the camera while permitting rapid camera deployment for normal use.

Figure 9:
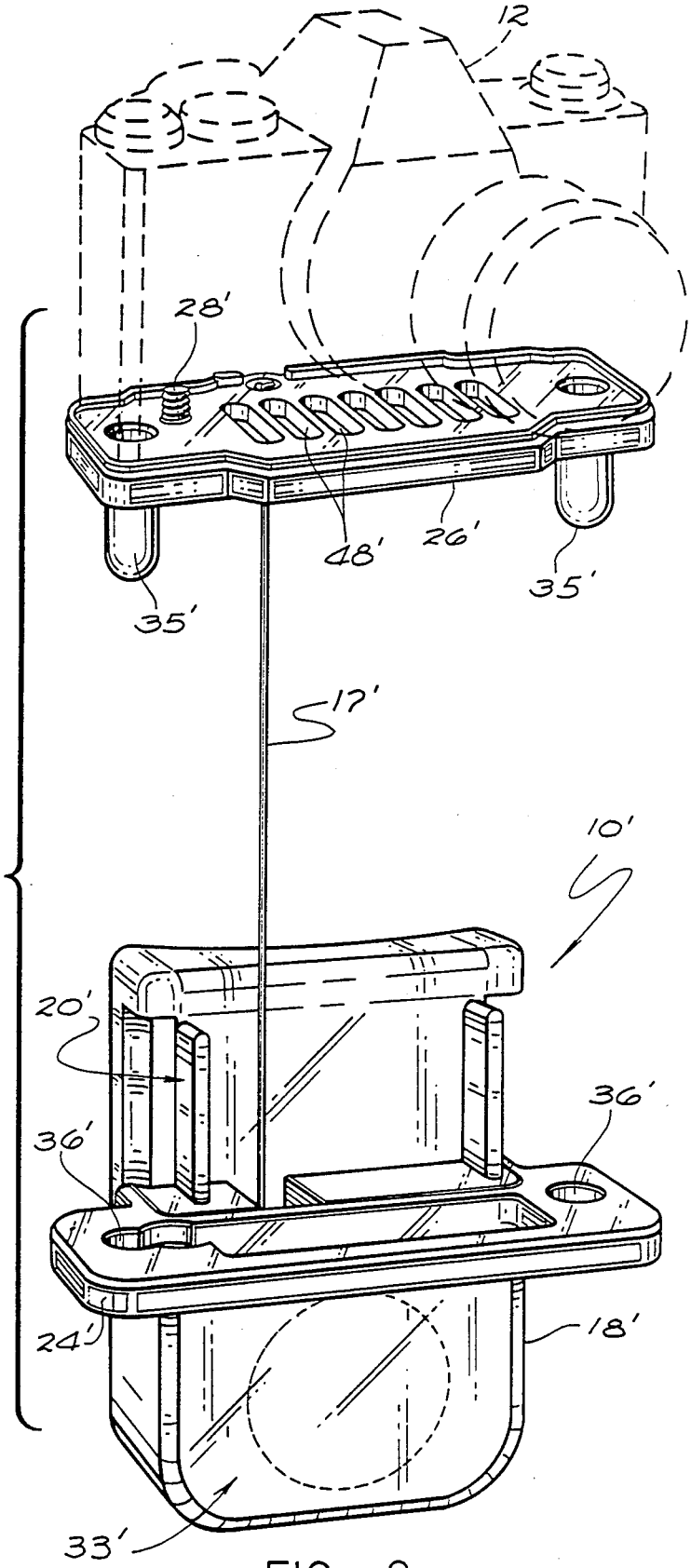
FIG. 9 is an exploded perspective view illustrating the camera carrier of FIGS. 7 and 8.
Figure 10:
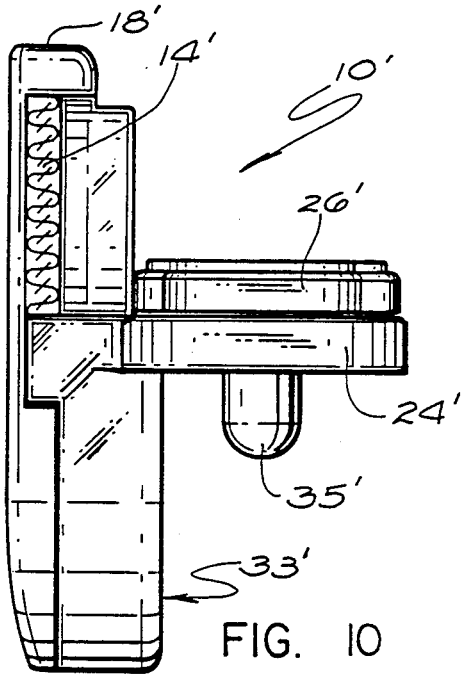
FIG. 10 is a side elevation view of the camera carrier of FIGS. 7–9.
Figure 11:
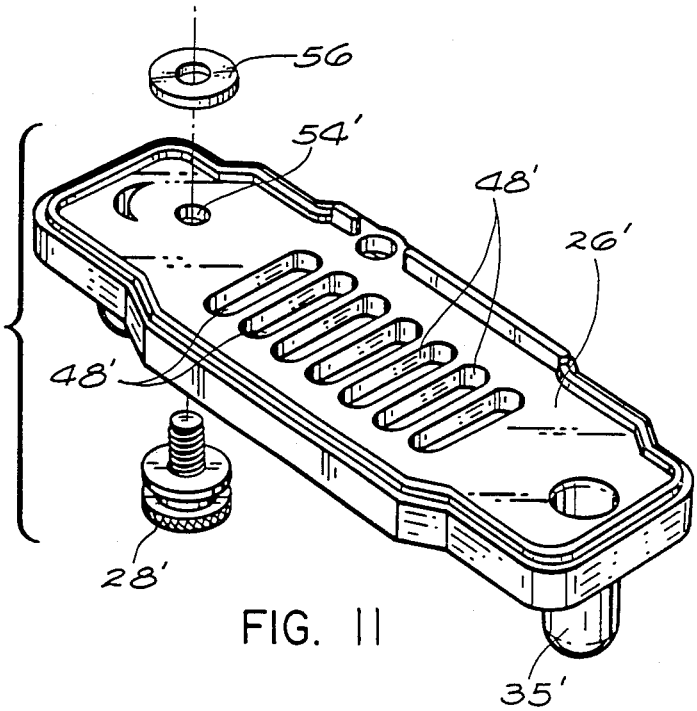
FIG. 11 is an enlarged exploded perspective view illustrating a carrier plate for use with the camera carrier of FIGS. 7–10.
Figure 12:
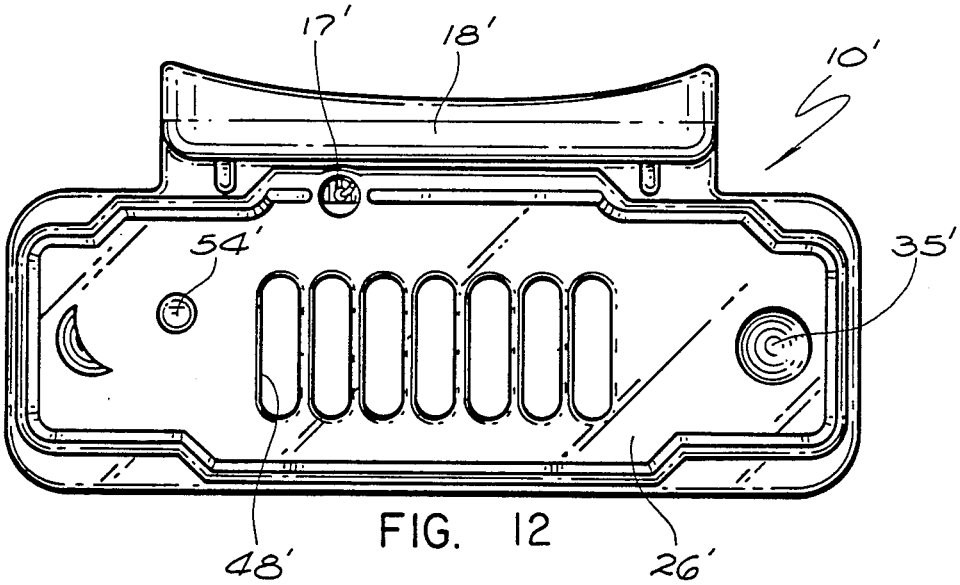
FIG. 12 is a top plan view of the camera carrier of FIGS. 7–11.

More specifically, as shown in detail in FIGS. 9 and 10, the modified frame 18' of the camera carrier 10' includes a generally horizontal support plate 24' having appropriate guide openings 36' for aligned reception of downwardly projecting guide posts 35' on an overlying carrier plate 26'. This carrier plate 26' is in turn adapted for connecton to the underside of a camera 12, and a retractable tether line 17' is suitably connected between the carrier plate 26' and a spring loaded reel assembly 33' on the frame 18'. In this embodiment, the tether line 17' is shown in the form of a sturdy cord of a selected flexible material such as a reinforced fabric or plastic or composite material or the like.

The carrier plate 26' is shown best in FIGS. 9–12 and includes a modified mounting means for secure connection onto the underside of a camera body. More specifically, the carrier plate 26' includes a transversely spaced set of elongated slots 48' which define a large number of transversely spaced mounting locations for upward passage of a connector screw 28' into the threaded tripod-mount bore (not shown) of a camera body. Alternately, or in addition, the carrier plate 26' includes one or more holes 54 through which the connector screw 28' may be fastened upwardly into the camera body. A washer 56 may be provided between the camera body and the carrier plate to insure secure attachment therebetween.

The modified embodiment 10' of the invention shown in FIGS. 7–12 functions in the same manner as previously described with respect to FIGS. 1–6. That is, the tether line 17' is normally drawn by spring forces into the reel assembly 33' to a minimum length position, with the carrier plate 26' seated in a secure and stable manner on the support plate 24'. The guide posts 35' on the carrier plate seat into the openings 36' in the support plate for secure retention of the camera 12 without necessitating use of the person's hands in carrying the camera. However, the camera can be lifted from the support plate at any time for normal photographic use. The tether line 17' extends to accommodate such use, but prevents complete separation of the camera from the person's belt 14 to protect against camera loss or theft.

A variety of further modifications and improvements of the present invention will be apparent to those skilled in the art. Accordingly, no limitation on the invention is intended by way of the description and drawings, except as set forth in the appended claims.

What is claimed is:

1. A camera carrier for use in supporting and carrying a camera from a person's belt, said camera carrier comprising:

a frame having a slot formed therethrough for reception of the belt of a person carrying the camera, said slot permitting mounting of said frame onto the belt;

a support plate extending outwardly from said frame when said frame is mounted at the belt of a person carrying the camera;

a carrier plate having a size and shape for seated support upon said support plate;

means for connecting said carrier plate to the camera;

a spring reel assembly mounted on said frame; and a flexible tether line connected between said spring reel assembly and said carrier plate, said spring reel assembly applying a spring force to said tether line for normally winding said tether line into said spring reel assembly when said carrier plate is seated upon said support plate, said spring reel assembly permitting extension of said tether line upon manual removal of said carrier plate from said support plate to permit normal photographic use of the camera without disconnecting the camera from said carrier plate.

2. The camera carrier of claim 1 wherein said means for connecting said carrier plate to the camera comprises means for connection to the camera in a range of different connection positions.

3. The camera carrier of claim 2 wherein the camera includes a camera body with a threaded tripod-mount bore formed in the underside of the camera body, said means for connecting said carrier plate to the camera comprising a plurality of elongated openings formed in said carrier plate in spaced relation to each other, and a connection screw fastened through a selected one of said openings and into the camera tripod-mount bore.

4. The camera of claim 3 wherein said carrier plate further includes at least one additional screw hole formed therein for selected passage of said connector screw.

5. The camera carrier of claim 2 wherein the camera includes a camera body with a threaded tripod-mount bore formed in the camera body, said means for connecting said carrier plate to the camera comprising a central opening formed in said carrier plate, a connector link having an elongated connector slot formed therein, means for connecting said link to said carrier plate in one of a plurality of selected different positions at the underside of said carrier plate, a spacer disk seated within said carrier plate central opening and having a thickness at least slightly greater than said carrier plate and a hole formed therethrough, and a connector screw fastened through said connector link slot and said spacer disk hole and into said camera tripod-mount bore.

6. The camera carrier of claim 1 further including guide means interengageable between said carrier plate and said support plate for securely supporting said carrier plate and camera upon said support plate.

7. The camera carrier of claim 1 wherein said frame has an inboard surface of a curvedly concave shape to generally match the contour of the body of the person carrying the camera.

8. A camera carrier for use in supporting and carrying a camera from a person's belt, said camera carrier comprising:

a frame adapted for mounting onto the belt of a person carrying the camera, said frame including an outwardly extending support plate;

a carrier plate having a size and shape for seating upon said support plate;

means for attaching said carrier plate to the camera;

a spring reel assembly mounted on said frame; and a flexible tether line connected between said spring reel assembly and said carried plate.

9. The camera carrier of claim 8 further including interengageable guide means on said carrier plate and said support plate for securely supporting said carrier plate and camera upon said support plate.

10. The camera carrier of claim 9 wherein said guide means comprises a pair of guide openings formed in said support plate and a pair of guide posts on said carrier plate for aligned and seated reception within said pair of guide openings in said support plate when said carrier plate is seated upon said support plate.

11. The camera carrier of claim 8 wherein said tether line is biased by said spring reel assembly toward a normal position wound substantially within said spring reel assembly when said carrier plate is seated upon said support plate, said spring reel assembly permitting unwinding extension of said tether line to permit manual removal of said carrier plate from said support plate.

12. The camera carrier of claim 8 wherein said camera carrier includes means for connection to the camera in a range of different connection positions.

13. The camera carrier of claim 8 wherein said tether line has a length to prevent the camera when connected to said carrier plate from striking the ground when said frame is mounted on the belt of a person.

14. A camera carrier for use in supporting and carrying a camera from a person's belt, said camera carrier comprising:

a frame adapted for mounting onto the belt of a person carrying the camera, said frame including an outwardly extending support plate;

a spring reel assembly mounted on said frame; and a flexible tether line having one end connected to said spring reel assembly and an opposite end including means for connection to the camera, said support plate having a size and shape for supporting the camera when said tether line in connected to the camera.

15. The camera carrier of claim 14 further including a carrier plate having a size and shape for seating upon said support plate, said opposite of said tether line being connected to said carrier plate, and said means for connection to the camera comprising means for connecting said carrier plate to the camera.

16. The camera carrier of claim 14 wherein said frame has a slot formed therethrough for passage of the belt of the person carrying the camera.

* * * * *